US005088677A

United States Patent [19]

Chandler et al.

[11] Patent Number: 5,088,677

[45] Date of Patent: Feb. 18, 1992

[54] RESTRAINT APPARATUS FOR PAGES AND THE LIKE

[76] Inventors: William H. Chandler, Rte. 3, Box 1855, Ellensburg, Wash. 98926; Francis D. Reynolds, 3060 W. Lake Sammamish Pkwy. N., Redmond, Wash. 98052

[21] Appl. No.: 448,302

[22] Filed: Dec. 11, 1989

Related U.S. Application Data

[63] Continuation-in-part of Ser. No. 240,804, Jul. 6, 1988, abandoned.

[51] Int. Cl.[5] ..... A47B 97/00

[52] U.S. Cl. ..... 248/451; 248/231.8; 248/296; 248/316.7

[58] Field of Search ..... 248/451, 452, 453, 201, 248/231.8, 229 R, 316.7, 296; 24/67 R, 67.3, 67.11; 281/42

[56] References Cited

U.S. PATENT DOCUMENTS

| | | | |
|---|---|---|---|
| 340,596 | 4/1886 | Mowat | 248/452 |
| 3,404,435 | 10/1968 | Freundlich | 24/67.9 |
| 3,914,007 | 10/1975 | Seidler | 248/67.9 X |
| 4,047,688 | 9/1977 | Knox et al. | 248/451 |
| 4,116,414 | 9/1978 | Robertson | 248/451 |
| 4,506,416 | 3/1985 | Ohminato et al. | 24/67 R |

FOREIGN PATENT DOCUMENTS

| | | | |
|---|---|---|---|
| 364434 | 6/1921 | Fed. Rep. of Germany | 281/42 |
| 700034 | 11/1940 | Fed. Rep. of Germany | 281/42 |
| 18438 | of 1900 | United Kingdom | 281/42 |
| 8522 | of 1910 | United Kingdom | 281/42 |

*Primary Examiner*—Karen J. Chotkowski
*Attorney, Agent, or Firm*—Robert W. Jenny

[57] ABSTRACT

The holders are attachable to the edges of planar support surfaces for music and serve to hold the music in place against the effects of wind, gravity and characteristics of the music material. Each holder comprises attachment apparatus and a spring arm extending from it to contact the music. In a preferred embodiment the spring comprises an arm portion and a pivot portion which, when the spring is relaxed, is at an 80° angle to the arm portion. The pivot portion is carried in a hole in the attachment apparatus, the hole and pivot portion being inclined at a 3° angle off of normal to the planar support surface angled toward the leafed material. The arm portion can thus be pivoted so that its end is either in or clear of the locations in which music is placed to be held. Height of the arm portion is adjustable by sliding the pivot portion in the hole in the attachment apparatus, thus accommodating variations in the thickness of the music material and allowing the arm to be positioned to lie flat against held material to allow free turning of unheld material.

1 Claim, 1 Drawing Sheet

RESTRAINT APPARATUS FOR PAGES AND THE LIKE

BACKGROUND OF THE INVENTION

This application is a Continuation-In-Part of application Ser. No. 240,804, filed July 6, 1988, to be abandoned when this application is duly filed.

FIELD

This invention is in the field of apparatus for holding pages in place against the tendency of pages in a book to turn without being turned and against the influences of air movements and gravity on the positioning of the pages, sheets of paper and the like. More specifically it is in the field of such apparatus used for holding in place on music stands pages and sheets on which music is written or printed, such pages and sheets themselves being termed music so that, accordingly, such apparatus has been termed music holders in the prior art.

PRIOR ART

Some of the prior art in this field is shown in in the following patents:

| | | | |
|---|---|---|---|
| U.S. Pat. No. | 340,596 | | 1,157,194 |
| | 369,475 | | 3,404,435 |
| | 458,074 | | 3,914,007 |
| | 475,126 | | 4,047,688 |
| | 738,473 | | 4,116,414 |
| | | 4,506,414 | |
| BRITISH: | 18,438 | | |

Other art is commercially available, primarily in the form of apparatus incorporated into music stands to facilitate holding the music in place. However, it is not known that any of the prior art has provided a commercially successful solution to the problem of holding and positioning music in place on a music holder or stand. For the apparatus to be commercially successful it must meet certain objectives which are the objectives of the subject invention. It is an objective that the subject apparatus be effective with music material ranging in thickness from that of a single sheet to that of a plurality of sheets, stacked or bound into a book, up to about 1½ inches thick. A second objective is that the apparatus be adaptable for use on a variety of types of music holders including those having simple sheet metal edges or flanged edges and others made of relatively thicker materials such as ¼ inch thick wood. A third objective is that the apparatus be simple to operate. A fourth objective is that the apparatus which actually engages the music be disengageable from the music without disengaging the holder from the music stand and readily re-engagable when desired. A fifth objective is that the music engaging apparatus lie close to the music when engaged, regardless of the thickness of the music. A sixth objective is that the apparatus be dependable in use in that it effectively holds the music and maintains adjustments made for it to hold the music. A seventh objective is that the apparatus be cost effective in that it is durable and manufacturable at relatively low cost. Other objectives are that the apparatus accommodate the two different thicknesses inherent in the use of bound music, that it not restrict the turning of unheld pages and that the apparatus be attachable to the top, the sides or both of the music support surface, attachment at the top enabling use of music wider than the support surface.

SUMMARY OF THE INVENTION

In an embodiment which is expected to find most general use the subject holder comprises a clamp which engages an edge at the top or side of the music support and a spring wire extending from the clamp to contact the music to be held. The music support has a planar surface against which the music is held. The clamp has a hole through it, the axis of the hole being in a plane perpendicular to the plane of the planar support surface when the clamp is engaging an edge of the support but angled slightly toward the music being held. The spring has a first portion called the arm portion which contacts the music and a second portion termed the pivot portion which, when the spring is in its relaxed state, is at an angle to the arm portion in the range of 75°–85°, 80° being preferred. The pivot portion extends through the hole in the clamp, i.e. toward and through the plane of the planar surface and is retained in the hole by a loop formed at the end of the pivot portion. The spring is free to rotate in the hole and the length of the pivot portion is such that it can move lengthwise of the portion in one direction until the clamp is contacted by the arm portion of the spring and in the other until stopped by the loop at its end.

Each assembly of the apparatus is termed a holder and the holders are generally used in pairs, one on each side of the tray of a music stand. To install a holder its clamp is clamped to the edge of the tray. If the holders are installed before the music is placed on the stand, the springs are pivoted so that the arm portion is clear of the tray. Once the music is in place as desired, the spring on each holder is pivoted so that the arm portion is over the point at which the arm is to hold the music and the pivot portion is pushed toward the plane of the tray, forcing the arm portion into deflected contact with the music. The force of the contact of the arm portion produces a force couple between the pivot portion and the structure at the ends of the hole in the clamp. Friction at the contact points between the pivot portion and the clamp holds the spring in the depressed position to hold the music in place. The arm portions lie close to the music over the full width of the music when the arms are fully engaged with the music. The arms can be engaged with and disengaged from the music without disengaging the clamps from the tray of the music stand. To release the music the springs may be rotated about the pivot portion so that the arm portions are out of contact with the music or they can be lifted and then pivoted, the lifting involving sliding of the pivot portion in the clamp. They can then be moved toward or away from the plane of the music support to allow adjustment for the thickness of and clamping of whatever music is next in place to be held.

In a preferred embodiment the clamp is an integral molded part. It comprises a fulcrum portion, first and second levers extending in one direction from the fulcrum portion and pincer elements extending from the fulcrum portion in the opposite direction. Each lever operates a pincer portion so that pressing the levers toward each other moves the pincer elements apart and relieving the pressure on the levers allows the resilience of the clamp to move the pincer elements toward each other. One pincer element is flat and is positioned flat against one of the broad surfaces of the music support surface when the clamp is in position on an edge of the surface. The other pincer element is shaped and positioned to contact the other broad surface of the music support surface and hold the flat pincer element firmly against the surface except when the levers are actuated to loosen the grip of the clamp. The pivot hole in the clamp is in a plane perpendicular to the flat pincer element and extends through the fulcrum portion. The hole is angled relative to the flat pincer element such that the pivot portion of a spring inserted in the clamp is at an angle in the range of 80° to 90° to the flat pincer and the support surface against which it is held when the clamp is in position on an edge of the surface. A preferred angle of the pivot portion to the support surface is 87°. The function of this angular positioning of the pivot portion of the spring is to cause the arm portion to lift away from the support surface when the spring is pivoted in the pivot hole rather than remain in contact with it as it would with the pivot hole perpendicular to the support surface. The clamp may be plastic or metal, possibly plastic coated entirely or at specific areas and made of more than one part in alternate embodiments.

The invention is described in more detail below with reference to the attached drawings.

BRIEF DESCRIPTION OF THE DRAWINGS

FIG. 3 shows the music and apparatus of FIG. 2 with the apparatus in its fully engaged state.

DETAILED DESCRIPTION OF THE INVENTION

Figure 1:
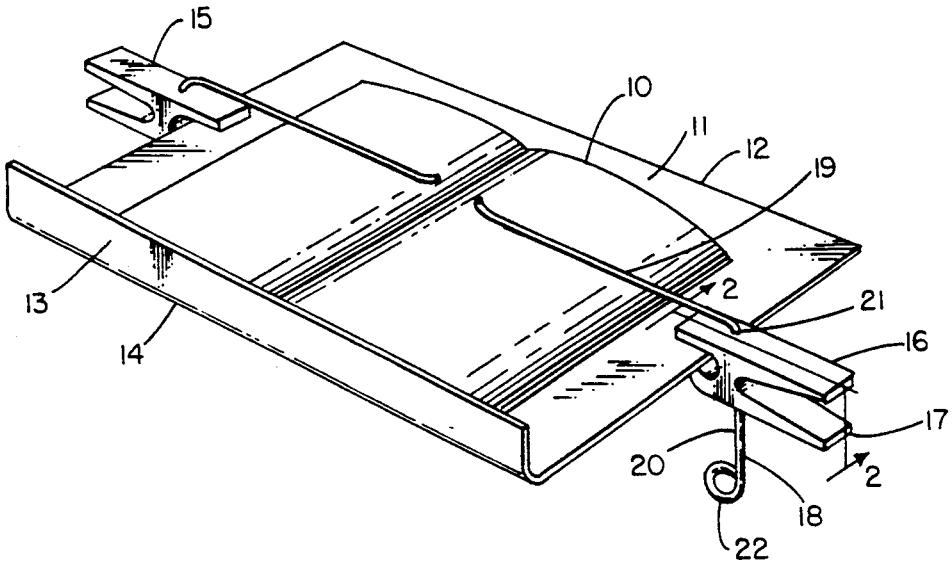
FIG. 1 is a perspective view of the tray of a music stand with music held by the subject holders.

In FIG. 1 music book 10 is supported on planar surface 11 of support structure 12 which is the tray of a music stand. Flange 13 at edge 14 of the tray prevents the book or other music on the tray from sliding off the tray when it is tilted toward the flange at the convenience of the musician using the music. Holders 15 and 16 are installed and in use to prevent the pages of the book from turning inadvertently because of the springy nature of the book or, for example, because of the wind acting on them. The holders are identical and holder 16 is described in more detail. It comprises attachment apparatus 17 here in the form of a one piece clamp and a one piece spring 18. Spring 18 comprises an arm portion 19 and a pivot portion 20 having a pivot axis. As shown, when the apparatus is fully engaged with the music the two portions are essentially at a right angle to each other and the pivot portion is installed in hole 21 in the attachment apparatus. When the holder is in place the hole and pivot portion are essentially normal to the plane of the support surface but at a slight angle toward the music, as described below. End 22 of the spring is looped to prevent inadvertent removal of the spring from the clamp.

Figure 2:
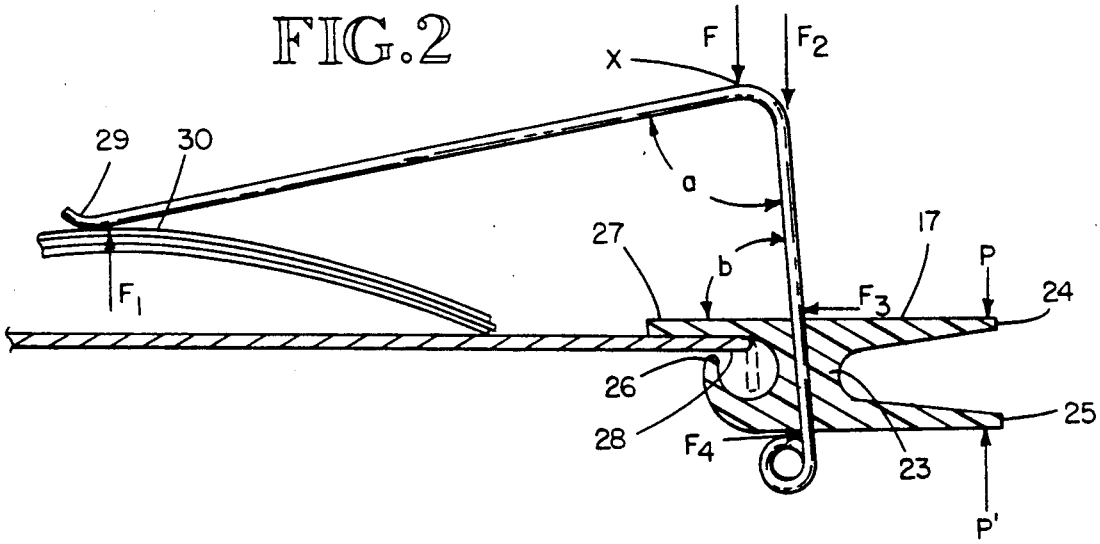

FIG. 2 is a sectional view of the holder in its relaxed state taken at 2—2 in FIG. 1. The angle a between the arm and pivot portions in the relaxed state is in the range of 75° to 85°, 80° being preferred. Clamp 17 is one piece and made of resilient material. Narrow section 23 functions as a fulcrum so that forces P and P′ applied at levers 24 and 25 will cause tip 26 to move away from tab 27, thus loosening the grip of the clamp on tray edge 28 so that the holder can be repositioned or removed. Removal of forces P and P′ allows the resilience of the part to force tip 26 against the tray edge to again clamp the holder in position.

It is essential to the function of the invention that tab 27 be held flat against surface 11 when the apparatus is installed and in use. With the tab so held pivot hole 21 and pivot portion 22 are held in a specific orientation with respect to surface 11. Their axes are in a plane perpendicular to surface 11 and at an angle b to surface 11, angle b being in the range of 80° to 89° with 87° preferred. With this orientation and with the spring in its relaxed state, when the spring is pivoted in hole 21, end 29 moves in a plane perpendicular to the axes of the hole and pivot portion and that plane is at an angle to the surface 11 in the range of 1° to 9° with 3° preferred. The plane is further from the surface at the edge of the surface than at its widthwise center. Accordingly, as the spring is pivoted end 29 moves away from surface 11 instead of along it as it would if hole 21 were perpendicular to the surface. This movement of end 29 toward and away from surface 11 during pivoting of the spring has been found to expedite engagement and disengagement of the spring with the music.

On some metal music stands the edges are flanged as indicated by the phantom lines. The clamp is shaped to easily fit around such flanges.

Figure 3:
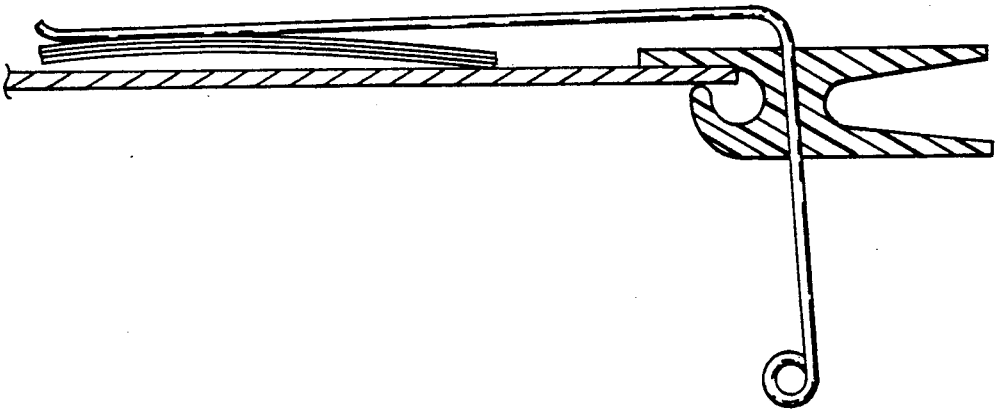
FIG. 3 is a sectional view of the holder of FIG. 1 taken at 2—2 in FIG. 1 with the holder in place on a music stand tray and the apparatus engaged but in its relaxed state.

When music is to be placed on the tray the spring is rotated about the pivot portion so that the arm portion is clear of the area on which the music is to be placed. When the music is in place the spring is rotated until end 29 of the arm portion is located over the music and then force F is applied at point X on the spring to move the pivot portion through the hole in the clamp in the direction toward the plane of the planar surface off the tray. This movement causes end 29 to contact music 30 with the arm deflected an amount dependent on how far the pivot portion is moved through the clamp after end 29 first contacts the music. In FIG. 3 the apparatus is shown in its engaged state with the arm portion shown in full engagement with the music, touching the music over virtually its full width and providing for optimum freedom and flatness of pages not held by the holders. In the engaged state angle a is in the range of 85° to 95°.

For the downward force on the music there is an equal and opposite force $F_1$ upward on the arm. This force is reacted by an equal but opposite force $F_2$ applied frictionally to the pivot portion at contact points between it and the clamp. Forces $F_1$ and $F_2$, being displaced a distance equal to the length of the arm portion, produce a force couple which is reacted by another couple involving forces $F_3$ and $F_4$ at the points of contact of the pivot portion with the clamp. Forces $F_3$ and $F_4$ produce the friction forces equal to force $F_2$ which hold the spring so that end 29 and arm 19 exert the required force on the music.

Details not given, such as material selection and detailed dimensions, are considered to be within the capabilities of persons of ordinary skill in the art to determine.

It is considered that it can be understood from this description that the invention meets its objectives. The motion of the pivot portion in the clamp, in combination with adequate length of the pivot portion, enables the invention to accommodate a desired range of thicknesses for each holder. The holders are usable on the edges of sheet material, flanged edges of sheet material and thicker material such as ¼ inch thick wood. The holders are easy to operate, requiring minimal finger strength and manual dexterity. They are easily and dependably adjustable to accommodate thickness variation of the music. They are simple and durable and lie flat against the held material so that unheld pages may be easily turned and can lie flat against the held material. Also, the holders can be attached anywhere along the top and sides of a music tray, enabling holding of music longer than the tray is wide.

Also, it is will be understood that while one embodiment of the invention is described herein, other embodiments and modifications of the one disclosed are possible within the scope of the invention. For example, the attachment apparatus may be fastened with fasteners or detented hinges to the tray instead of with clamps. The spring or the attachment apparatus may each comprise more than one part. Also apparatus which does not extend through or beyond the music stand tray is within the scope of the invention which is limited only by the appended claims.

We claim:

1. Restraint apparatus for holding leafed material in place on a planar support surface having at least one edge, said leafed material having a width, said apparatus having a relaxed state and an engaged state and comprising:

a resilient component having a pivot portion having a pivot axis and an arm portion at an angle to each other in the range of 75 degrees to 85 degrees, means for attaching said apparatus to said at least one edge and supporting said resilient component, said means for attaching having a hole having an axis, said means for attaching comprising clamping means which further comprises a tab having a center portion and a tip, said tab and said tip being disposed such that said tip is opposite said center portion, whereby, when said means for attaching is attaching said apparatus, said center portion is firmly held essentially parallel to said surface, said resilient component being supported by said means for attaching by said pivot portion in said hole and pivotable and slidable in said hole, whereby said resilient component is attached to said surface by said means for attaching with said pivot axis in a plane essentially perpendicular to said planar surface and with capability for slidable and rotatable adjustments of the position of said resilient component with respect to said surface, said slidable adjustment being adjustment of said distance by sliding said pivot portion in said hole and said rotatable adjustment being rotation of said arm portion with respect to said surface and rotation of said pivot portion in said hole, whereby said resilient component is put into said engaged state from said relaxed state by said sliding of said pivot portion in said hole toward said surface such that said arm contacts said leafed material over virtually all of said width and said angle in the range of 75 degree to 85 degree is increased to an angle in the range of 85 degrees to 95 degrees; and whereby said axis of said hole in said means for attaching and said pivot axis lie in a plane perpendicular to said surface and said axes are disposed at an angle to said surface in the range of 80 degrees to 89 degrees, whereby when said arm is rotated out of said plane, the arm moves away from said leafed material.

* * * * *